US010951984B2

(12) United States Patent
Horiuchi

(10) Patent No.: US 10,951,984 B2
(45) Date of Patent: Mar. 16, 2021

(54) ACOUSTIC SIGNAL MIXING DEVICE AND COMPUTER-READABLE STORAGE MEDIUM

(71) Applicant: KDDI CORPORATION, Tokyo (JP)

(72) Inventor: Toshiharu Horiuchi, Fujimino (JP)

(73) Assignee: KDDI CORPORATION, Tokyo (JP)

( * ) Notice: Subject to any disclaimer, the term of this patent is extended or adjusted under 35 U.S.C. 154(b) by 0 days.

(21) Appl. No.: 16/749,368

(22) Filed: Jan. 22, 2020

(65) Prior Publication Data

US 2020/0162816 A1 May 21, 2020

Related U.S. Application Data

(63) Continuation of application No. PCT/JP2018/034801, filed on Sep. 20, 2018.

(30) Foreign Application Priority Data

Sep. 29, 2017 (JP) ..... JP2017-190863

(51) Int. Cl.
*H04R 3/00* (2006.01)
*H04R 1/40* (2006.01)
*H04R 29/00* (2006.01)

(52) U.S. Cl.
CPC ..... *H04R 3/005* (2013.01); *H04R 1/406* (2013.01); *H04R 29/005* (2013.01)

(58) Field of Classification Search
None
See application file for complete search history.

(56) References Cited

U.S. PATENT DOCUMENTS 7,333,622 B2 2/2008 Algazi et al.
2004/0076301 A1 4/2004 Algazi et al.
2007/0009120 A1 1/2007 Algazi et al.
(Continued)

FOREIGN PATENT DOCUMENTS

JP 2005-244664 A 9/2005
JP 2006-503526 A 1/2006
(Continued)

OTHER PUBLICATIONS

International Search Report for PCT/JP2018/034801 dated Nov. 6, 2018.
(Continued)

*Primary Examiner* — Paul W Huber
(74) *Attorney, Agent, or Firm* — Thomas | Horstemeyer, LLP

(57) ABSTRACT

A mixing device includes: processing units each provided for a set of two microphones, each processing unit being configured to process acoustic signals output by the corresponding set of two microphones to output a first acoustic signal and a second acoustic signal; a first adding units configured to add up the first acoustic signals; and a second adding unit configured to add up the second acoustic signals. Each processing unit processes the acoustic signals output by the corresponding set of two microphones, based on a scaling factor that determines a scaling up/down rate of a sound field, a shift factor that determines a shift amount of the sound field, and attenuation factors that determine attenuation amounts of the acoustic signals output by the microphones.

12 Claims, 6 Drawing Sheets

(56) References Cited

U.S. PATENT DOCUMENTS

| | | | | |
|---|---|---|---|---|
| 2008/0056517 | A1 | 3/2008 | Algazi et al. | |
| 2010/0027808 | A1* | 2/2010 | Hamada | H04S 5/005 381/92 |
| 2010/0166212 | A1* | 7/2010 | Ishibashi | H04R 1/403 381/92 |
| 2015/0156578 | A1* | 6/2015 | Alexandridis | H04R 3/005 381/92 |

FOREIGN PATENT DOCUMENTS

| | | | |
|---|---|---|---|
| JP | 3905364 | B2 | 4/2007 |
| JP | 2016-046699 | A | 4/2016 |
| JP | 2018-026701 | A | 2/2018 |
| WO | 2004039123 | A1 | 5/2004 |
| WO | 2019/065447 | A1 | 4/2019 |

OTHER PUBLICATIONS

Umayahara, T., et al., "Stereo Width Control Using Interpolation and Extrapolation of Time-Frequency Representation", IEEE Transactions on Audio, Speech, and Language Processing, United States of America, IEEE, Jul. 2006, vol. 14, No. 4, pp. 1364-1377.

Office Action for Japanese Patent Application No. 2017-190863 dated Oct. 9, 2020.

* cited by examiner

ACOUSTIC SIGNAL MIXING DEVICE AND COMPUTER-READABLE STORAGE MEDIUM

CROSS-REFERENCE TO RELATED APPLICATION(S)

This application is a continuation of International Patent Application No. PCT/JP2018/034801 filed on Sep. 20, 2018, which claims priority to and the benefit of Japanese Patent Application No. 2017-190863 filed on Sep. 29, 2017, the entire disclosures of which are incorporated herein by reference.

TECHNICAL FIELD

The present invention relates to a technique for mixing acoustic signals collected by a plurality of microphones.

BACKGROUND ART

Recently, virtual reality (VR) systems using a head-mounted display have been provided. Such a VR system displays images that correspond to a field of view of a user wearing the head-mounted display on the display.

Sounds that are output from speakers of the head-mounted display together with the images were collected by, for example, a plurality of microphones. FIG. 1 is a diagram illustrating an example of the sound collecting method. Referring to FIG. 1, eight microphones in total, namely, microphones 51 to 58 are arranged on the circumference of a circle with a predetermined radius centered at a position 60. If acoustic signals collected by the microphones 51 to 58 are directly mixed and are output to the speakers, the sounds collected by the microphones 51 to 58 will be output from the speakers at the same level. If sounds collected by the microphones 51 to 58 are reproduced at the same level when, for example, an image in the range between the reference numerals 61 and 62 shown in FIG. 1 is displayed on the head-mounted display, a difference will occur between the range of view of the user and the range of the sound field.

Patent literature 1 discloses a configuration for adjusting the range of a sound field, by processing acoustic signals collected by two microphones based on a scaling up/down rate of the sound field to generate two acoustic signals for a right (R) channel and a left (L) channel, and driving a pair of speakers with the two acoustic signals for the R channel and the L channel.

CITATION LIST

Patent Literature

PTL 1: Japanese Patent No. 3905364

SUMMARY OF INVENTION

Technical Problem

Patent literature 1 discloses adjusting the range of a sound field of acoustic signals collected by two microphones, but does not disclose adjusting the range of a sound field of acoustic signals collected by three or more microphones.

Solution to Problem

According to one aspect of the present invention, a mixing device for mixing acoustic signals collected by a plurality of microphones includes: processing units that are each provided for a set of two microphones, out of the plurality of microphones, that are defined based on positions at which the microphones are arranged, each processing unit being configured to process acoustic signals output by the corresponding set of two microphones to output a first acoustic signal and a second acoustic signal; a first adding unit configured to add up the first acoustic signals output by the processing units that correspond to the respective sets and output the resultant signal; and a second adding unit configured to add up the second acoustic signals output by the processing units that correspond to the respective sets and output the resultant signal, wherein each processing unit processes the acoustic signals output by the corresponding set of two microphones, based on a scaling factor that determines a scaling up/down rate of a sound field, a shift factor that determines a shift amount of the sound field, and attenuation factors that determine attenuation amounts of the acoustic signals output by the microphones.

DESCRIPTION OF EMBODIMENTS

Hereinafter, an exemplary embodiment of the present invention will be described with reference to the drawings. Note that the following embodiment is illustrative, and the present invention is not intended to be limited to the content of the embodiment. Also, constituent components not essential for the description of the embodiment are omitted from the following figures.

Figure 1:
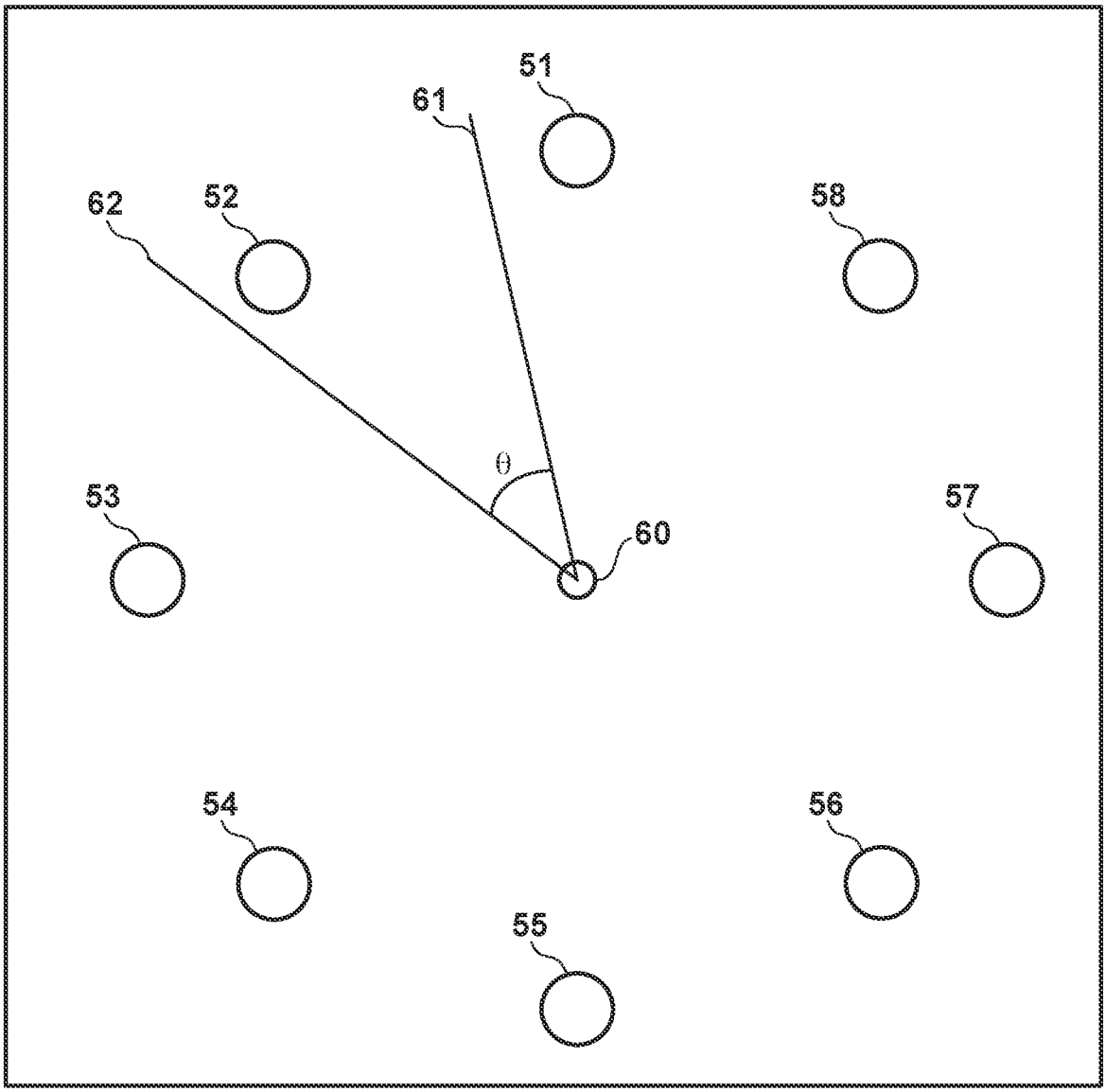
FIG. 1 is a diagram illustrating an example of a sound collecting method.
Figure 2:
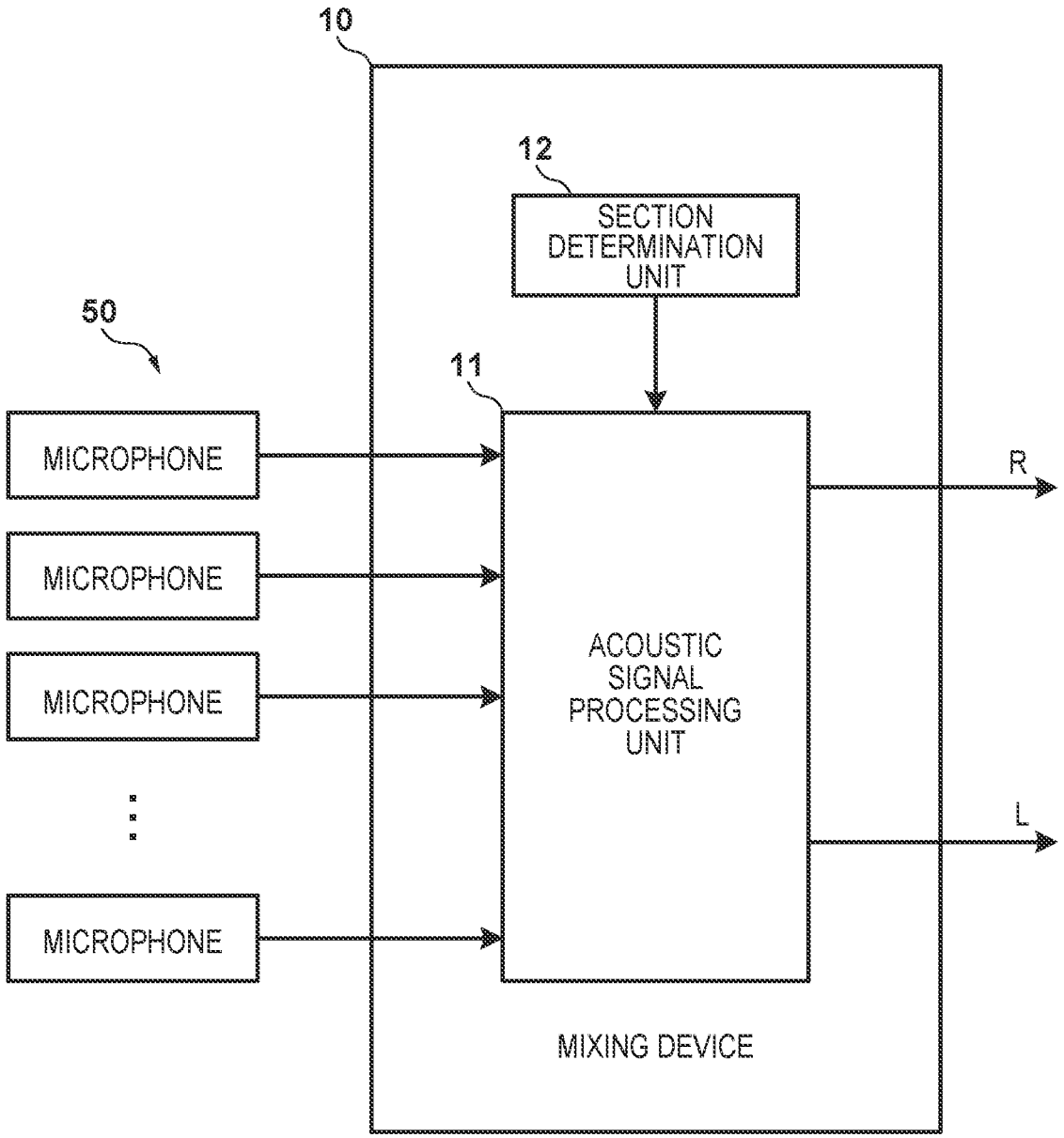
FIG. 2 is a diagram illustrating a configuration of a mixing device according to an embodiment.

FIG. 2 is a diagram illustrating a configuration of a mixing device 10 according to the present embodiment. Acoustic signals from a plurality of microphones 50 are input to an acoustic signal processing unit 11 of the mixing device 10. The plurality of microphones 50 are arranged, for example, on the circumference of a circle with a predetermined radius centered at a position 60 as shown in FIG. 1. Note that a configuration is also possible in which the plurality of microphones 50 are arranged at positions geographically different from the positions on the circumference of a circle, such as positions on a straight line or a curve in an arbitrary shape, for example. A plurality of directional microphones may also be arranged at the position 60 while being directed in different directions so as to collect sounds. The acoustic signal processing unit 11 outputs, based on the acoustic signals from the plurality of microphones 50, two acoustic signals, namely, an acoustic signal for a right channel (R) (hereinafter, referred to as an "acoustic signal R") and an acoustic signal for a left channel (L) (hereinafter, referred to as an "acoustic signal L"). These two acoustic signals are used to drive a set of speakers.

First, the acoustic signal processing unit 11 will be described with reference to FIG. 3. In the present embodiment, microphones 50 arranged adjacent to each other constitute a set. For example, in the arrangement shown in FIG. 1, the microphone 51 and the microphone 52 constitute a set, and the microphone 52 and the microphone 53 constitute a set. The same applies to the others, namely, the microphone 57 and the microphone 58 constitute a set, and the microphone 58 and the microphone 51 constitute a set. In other words, the arrangement shown in FIG. 1 includes eight sets in total. Thus, if a plurality of microphones are arranged on a closed curve, N sets are formed by N microphones. On the other hand, if a plurality of microphones are arranged on a non-closed line, for example, if a plurality of microphones are arranged on a straight line, (N−1) sets are formed by N microphones. Note that a configuration is also possible in which, even if a plurality of microphones are arranged on a closed curve, when the microphones are arranged in a portion thereof, (N−1) sets are formed by N microphones.

Figure 3:
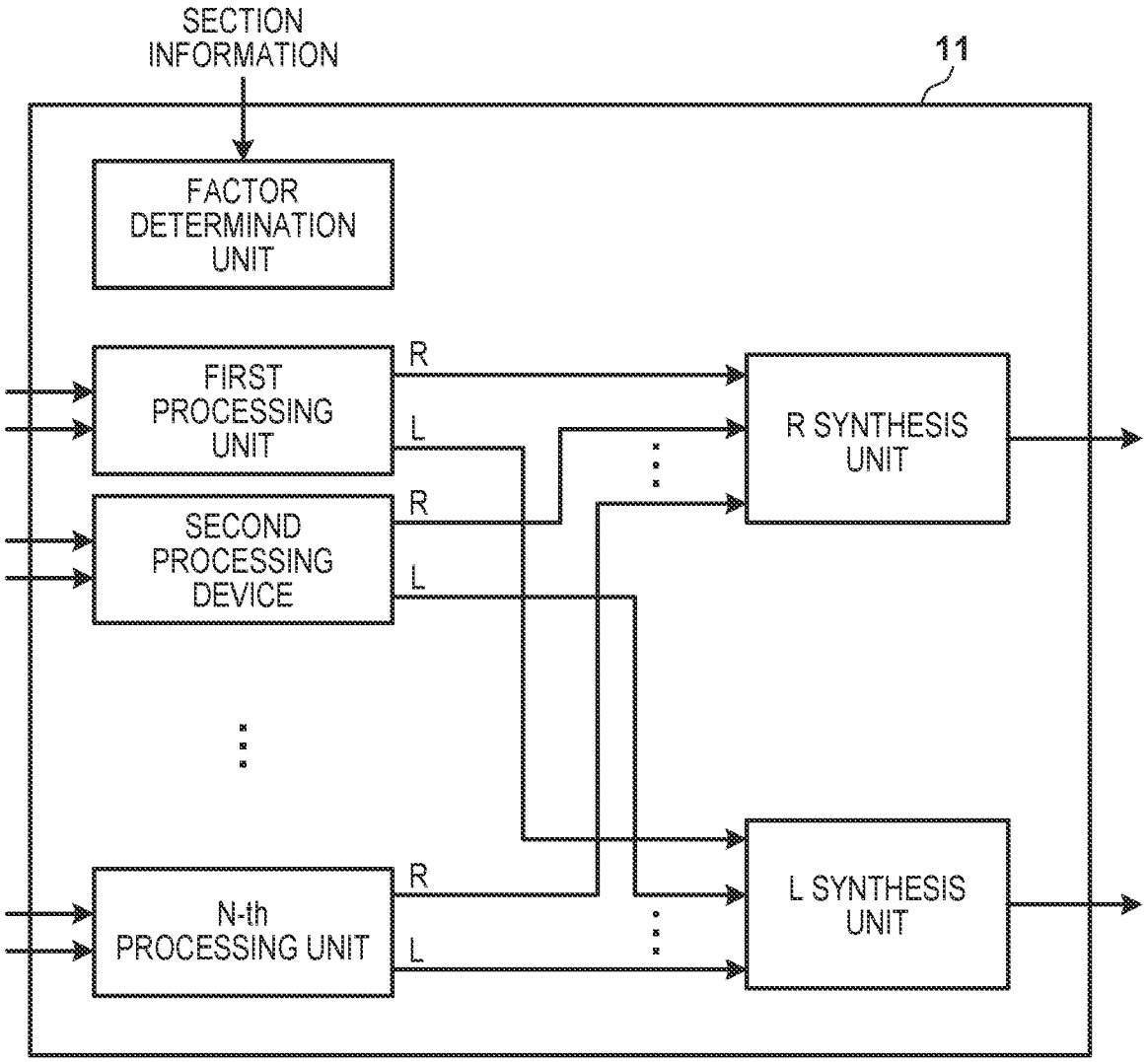
FIG. 3 is a diagram illustrating a configuration of an acoustic signal processing unit according to an embodiment.

As shown in FIG. 3, the acoustic signal processing unit 11 includes processing units the number of which corresponds to the number of sets. In FIG. 3, N processing units in total from a first processing unit to the N-th processing unit are provided. Note that the first processing unit to the N-th processing unit perform the same processing. Each processing unit outputs, based on acoustic signals input from a set of two microphones on which the processing is performed, an acoustic signal R for the right channel and an acoustic signal L for the left channel.

The following will describe processing that is performed in a processing unit. First, an acoustic signal collected by the microphone A is referred to as an acoustic signal A, and an acoustic signal collected by the microphone B is referred to as an acoustic signal B, and the acoustic signal A and the acoustic signal B are assumed to be input to the processing unit. The processing unit subjects the acoustic signal A and the acoustic signal B to discrete Fourier transformation at each predetermined time section. In the following, signals in the frequency domain obtained by subjecting the acoustic signal A and the acoustic signal B to discrete Fourier transformation are respectively referred to as a signal A and a signal B. The processing unit generates, using the following Formula (1), a signal R (right channel) and a signal L (left channel) in the frequency domain based on the signal A and the signal B. Note that the processing indicated by Formula (1) is performed on each frequency component (bin) of the signal A and the signal B. Then, the processing unit subjects the signal R and the signal L in the frequency domain to inverse discrete Fourier transformation, and outputs two acoustic signals, namely, the acoustic signal R and the acoustic signal L. An R synthesis unit adds up the acoustic signals R output by the first processing unit to the N-th processing unit and outputs one resultant acoustic signal R. Similarly, an L synthesis unit adds up the acoustic signals L output by the first processing unit to the N-th processing unit and outputs one resultant acoustic signal L. The acoustic signal R and the acoustic signal L output by the R synthesis unit and the L synthesis unit are respectively used to drive the speaker for the R channel and the speaker for the L channel, as described above.

[Formula 1]

$$\begin{pmatrix} R \\ L \end{pmatrix} = MTK\begin{pmatrix} A \\ B \end{pmatrix} \tag{1}$$

$$M = \begin{pmatrix} m_1 & 0 \\ 0 & m_2 \end{pmatrix}$$

$$T = \begin{pmatrix} e^{j\pi f\tau} & 0 \\ 0 & e^{-j\pi f\tau} \end{pmatrix}$$

$$K = \begin{pmatrix} ae^{-jb\Phi} & be^{ja\Phi} \\ be^{-ja\Phi} & ae^{jb\Phi} \end{pmatrix}$$

$$a = (1+\kappa)/2$$

$$b = (1-\kappa)/2$$

In Formula (1), f is a frequency (bin) to be processed, and Φ is a main value of the deflection angles of the two acoustic signals A and B. Therefore, in Formula (1), f and Φ are values that depend on the acoustic signal A and the acoustic signal B that are to be processed. On the other hand, in Formula (1), $m_1$, $m_2$, τ, and κ are variables that are determined by a factor determination unit and are given to the processing units for notification. The following will describe technical meanings of the variables.

Figure 4A:
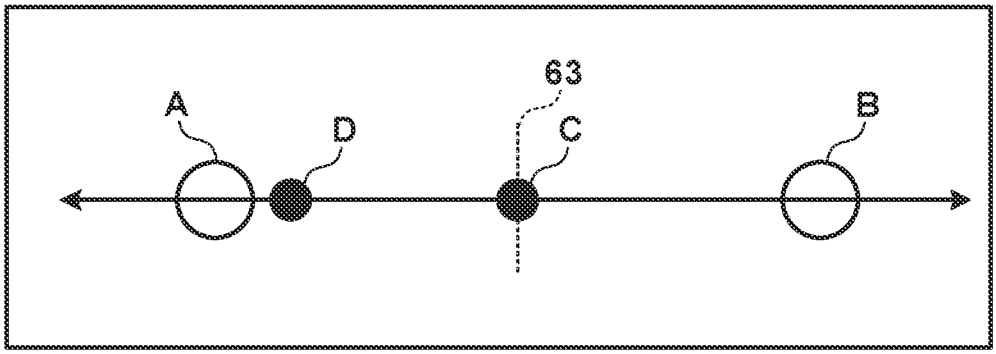
FIG. 4A illustrates processing performed by a processing unit according to an embodiment.

$m_1$ and $m_2$ are attenuation factors and take values between 0 and 1 inclusively. Note that $m_1$ determines the attenuation amount of the signal A, and $m_2$ determines the attenuation amount of the signal B. In the following, $m_1$ is referred to as an attenuation factor of the microphone A, and $m_2$ is referred to as an attenuation factor of the microphone B.

κ is a scaling (scaling up/down) factor, and determines the sound field range. Note that the scaling factor κ takes a value between 0 and 2 inclusively. It is assumed, for example, that the microphone A and the microphone B are arranged as shown in FIG. 4A. It is here assumed that $m_1$ and $m_2$ are set to 1, and τ is set to 0. In other words, matrices M and T are assumed to be set to values that do not change the signal A and the signal B. Here, if κ is set to 1, "signal R=signal A", and "signal L=signal B" will be met. In other words, the signal R and the signal L are equivalent to the signal A and the signal B, and thus the acoustic signals R and the acoustic signal L, which are obtained by subjecting the signal R and the signal L to inverse discrete Fourier transformation, are equivalent to the signals in the time domain that are collected by the microphone A and the microphone B. Therefore, when the speakers are disposed at the positions of the microphone A and the microphone B, and are respectively driven with the acoustic signal R and the acoustic signal L, the sound field range in the direction in which the microphone A and the microphone B are arranged is equivalent to the range in which the microphone A and the microphone B collect signals, as shown in FIG. 4A. For example, it is assumed that sound sources C and D are located at the positions shown in FIG. 4A. Note that the position 63 is an intermediate position of the straight line connecting the microphone A and the microphone B. In this case, in the reproduced sound, the sound images of the sound source C and the sound source D are located at the same positions as the positions at which the sound source C and the sound source D are arranged.

Figure 4B:
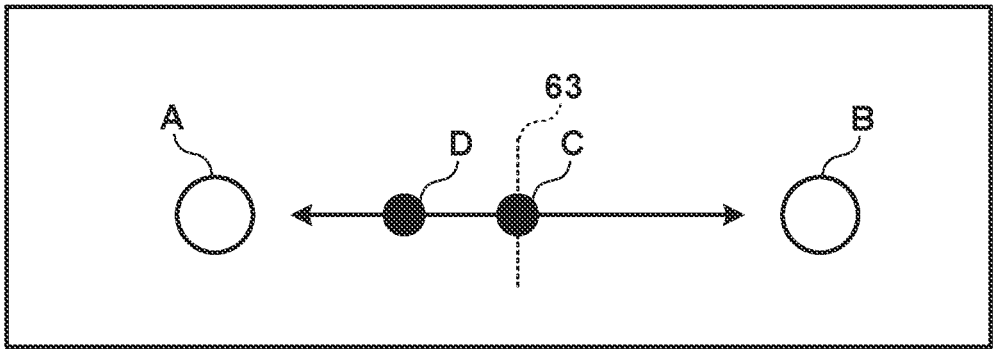
FIG. 4B illustrates processing performed by the processing unit according to an embodiment.
Figure 4C:
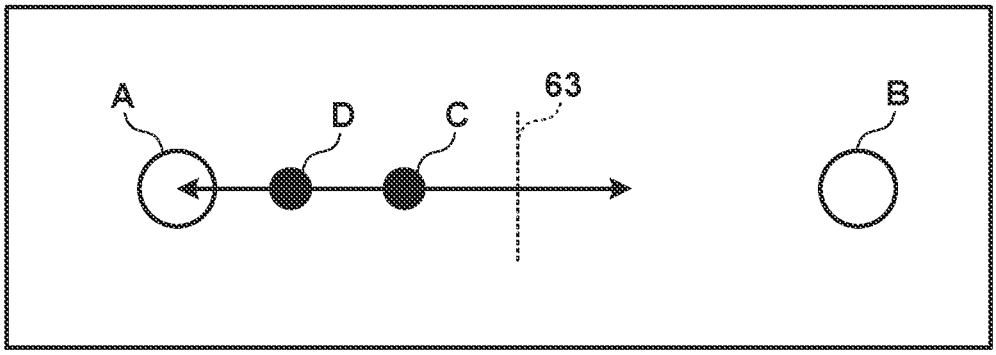
FIG. 4C illustrates processing performed by the processing unit according to an embodiment.

On the other hand, if $m_1$ and $m_2$ are set to 1, τ is set to 0, and κ is set to be less than 1, the sound field range is narrower than that of the case where κ is 1, as shown in FIG. 4B. At this time, when, for example, the speakers are disposed at the positions of the microphone A and the microphone B, and are respectively driven with the acoustic signals R and the acoustic signal L, the sound image of the sound source C is located at the same position as the position at which the sound source C is arranged, namely, the intermediate position 63. However, the position of the sound image of the sound source D is closer to the intermediate position 63 than the position at which the sound source D is arranged. In contrast, if κ is larger than 1, the sound field range is wider than that of the case where κ is 1. The scaling factor κ is thus a factor that scales up/down the sound field range.

τ is a shift factor, and takes a value in the range of −x to +x. When τ=0 as described above, the matrix T does not affect the signal A and the signal B. On the other hand, in cases other than the case where τ=0, the matrix T gives the phase changes of different signs with the same absolute value into the signal A and the signal B respectively. Accordingly, the position of the sound image is shifted toward the microphone A or the microphone B according to the value of τ. Note that the direction of shift depends on whether τ is positive or negative, and the greater the absolute value of τ is, the larger the shift amount thereof is. FIG. 4C shows the sound field range when τ is set to a value other than 0 under the condition that K matches the sound field range shown in FIG. 4B. The positions of the sound images of the sound sources C and D are shifted to the left side of the drawing with respect to the positions shown in FIG. 4B. In other words, the sound field is shifted to the left side. Note that, in FIGS. 4A to 4C, for illustrative purposes, the speakers are assumed to be disposed at the positions of the microphone A and the microphone B, but the distance between the positions at which the two speakers for the R channel and for the L channel are respectively disposed can be set to an arbitrary distance. In this case, the sound field range depends on the distance between the positions at which the speakers are disposed.

Figure 5:
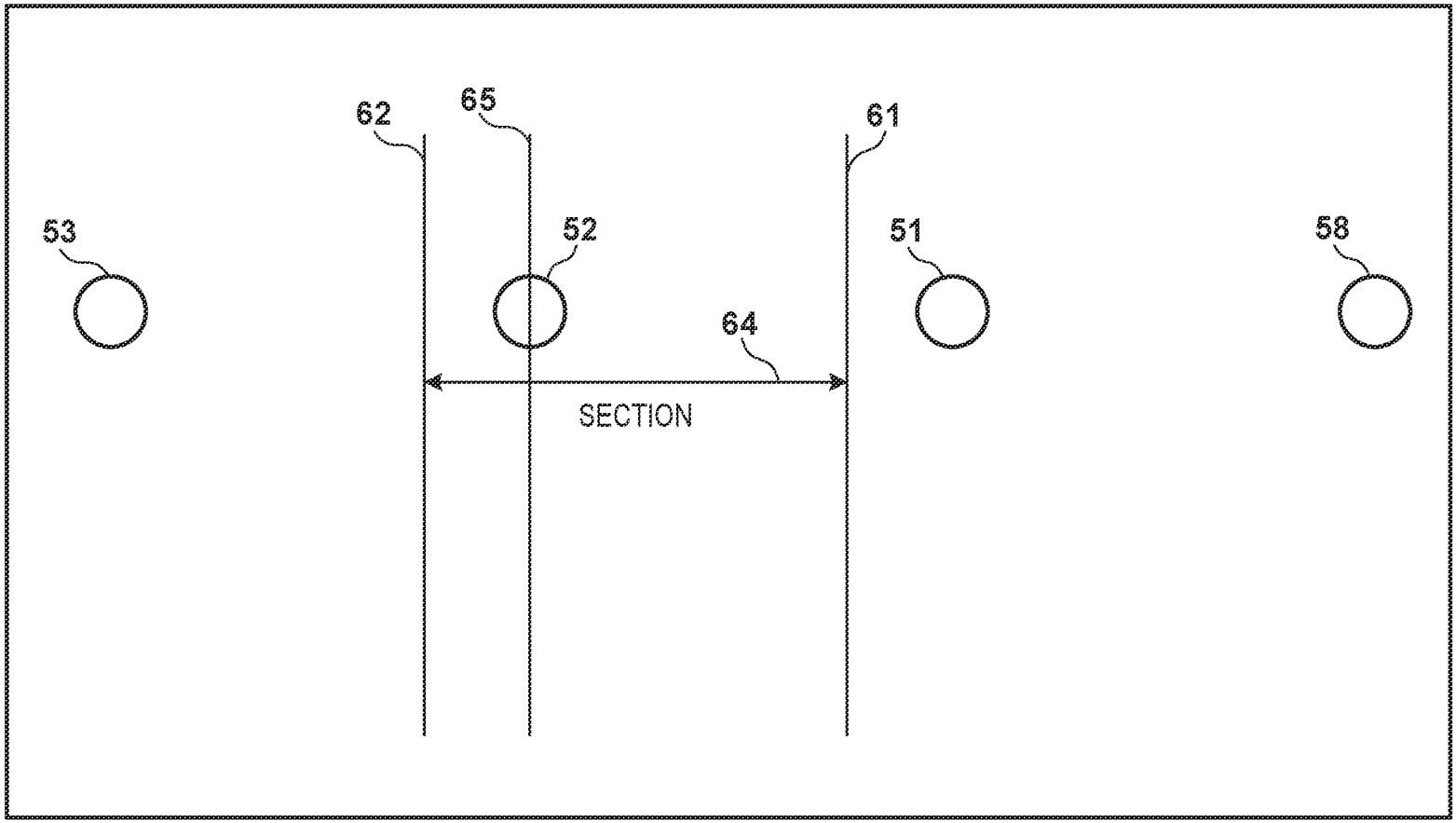
FIG. 5 illustrates a section according to an embodiment.

As described above, the factor determination unit of the acoustic signal processing unit 11 determines the factors, namely, $m_1$, $m_2$, τ, and κ of each of the first processing unit to the N-th processing unit, and notifies the first processing unit to the N-th processing unit of them. The following will describe how to determine the factors of the processing units by the factor determination unit of the acoustic signal processing unit 11. Section information indicating a section is input to the factor determination unit from a section determination unit 12 (FIG. 2). The section information indicates a section extending along a straight line or a curve on which a plurality of microphones are arranged. For example, it is assumed that, as shown in FIG. 1, the microphones 51 to 58 are arranged on the circumference of a circle, and the angles and the directions of the microphones with respect to the central position are designated by a user. In other words, it is assumed that the range between a line 61 and a line 62 is designated by the user. In this case, the section information indicates, as shown in FIG. 5, a section 64, which is the range between two intersections of the circumference on which the plurality of microphones are arranged and the lines 61 and 62. Note that, in FIG. 5, for ease of illustration, the shape of the circumference is indicated by a straight line.

Figure 6A:
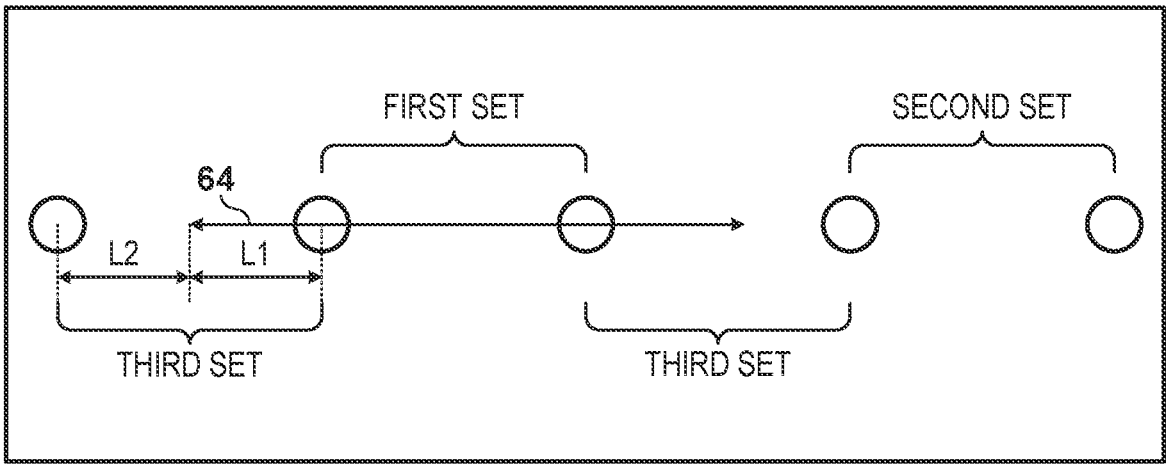
FIG. 6A illustrates determination of factors according to an embodiment.
Figure 6B:
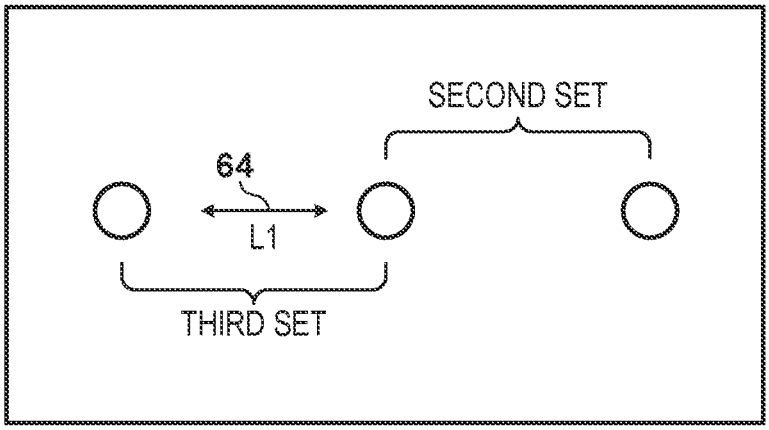
FIG. 6B illustrates determination of factors according to an embodiment.

The factor determination unit of the acoustic signal processing unit 11 stores information indicating respective positions at which the plurality of microphones are arranged, and classifies the sets of microphones based on the section 64 indicated by the section information and the positions at which the microphones are arranged. FIGS. 6A and 6B illustrate classification of sets. In FIGS. 6A and 6B, a circle indicates each of the microphones. First, the factor determination unit determines whether or not at least one microphone is included in the section 64. If at least one microphone is included in the section 64, the factor determination unit determines, as shown in FIG. 6A, a set of two microphones that are included in the section 64 as a first set, a set of two microphones that are not included in the section 64 as a second set, and a set of two microphones one of which is included in the section 64 but the other one of which is not included in the section 64 as a third set. On the other hand, if no microphones are included in the section 64, the factor determination unit determines, as shown in FIG. 6B, a set of two microphones that are located closest to the section 64 as the third set, and the other sets of microphones as the second sets.

The following will describe how to determine, for each of the first to third sets, the factors to be used by the corresponding processing unit. Note that, in the following, the factors to be used by the processing unit that corresponds to a set are expressed simply as "factors for the set". Furthermore, it is assumed that the length of a portion of the section 64 that is present between a third set of two microphones is denoted by "L1" as shown in FIGS. 6A and 6B, and the portion with the length L1 is referred to as an overlapping section. Furthermore, it is assumed that the remaining portion between the third set of two microphones other than the section 64 is referred to as a non-overlapping section. In FIG. 6A, the portion with the distance L2 is a non-overlapping section, and in FIG. 6B, there are two non-overlapping sections on both sides of the section 64. For example, the factor determination unit sets, for the first set, τ to 0, κ to 1, and the attenuation factors of the two microphones to 1. In other words, with these values, the sound field does not scales up/down, and is not shifted, and the attenuation amounts are set such that the acoustic signals collected by the two microphones are not attenuated.

On the other hand, the factor determination unit determines the scaling factor κ and the shift factor τ of a third set so that the sound field range corresponds to the overlapping section. In other words, the factor determination unit determines the scaling factor κ of the third set based on the length L1 of the overlapping section. Specifically, for example, if the distance between the third set of two microphones is "L", the scaling factor κ for the third set is determined so that the scaling up/down rate is L1/L. Accordingly, the factor determination unit determines the scaling factor κ of the third set so that the shorter the length of the overlapping section of the third set is, the narrower the sound field range is. Furthermore, the factor determination unit determines the shift factor τ of the third set so that the central position of the sound field is located at the central position of the overlapping section. Accordingly, the factor determination unit determines the shift factor of the third set based on the distance between the midpoint between the positions at which the two microphones are arranged, and the midpoint of the overlapping section. Furthermore, the factor determination unit sets the attenuation factors of the third set of two microphones to 1. Alternatively, the factor determination unit sets the attenuation factor of the microphone of the third set that is included in the section 64 to 1, or to the same value of the attenuation factors of the first set of two microphones, and sets the attenuation factor of the microphone that is not included in the section 64 to a value with which the attenuation amount is larger than the attenuation amount for the microphone that is included in the section 64. Alternatively, the factor determination unit may set the attenuation factor of the microphone of the third set that is not included in the section 64 to a value with which the attenuation amount is larger, the greater the length of the non-overlapping section is, that is, the greater the shortest distance L2 from the position at which the microphone is arranged to the section 64 is.

Furthermore, in the same manner as for the first set, the factor determination unit sets, for the second set, $\tau$ to 0 and $\kappa$ to 1, for example. However, the factor determination unit sets the attenuation factors of the two microphones to a value with which the attenuation amount is larger than in the case of the attenuation factors set for the first and third sets of microphones. As an example, the factor determination unit sets the attenuation factors of the second set of two microphones to a value with which the attenuation amount is the largest, that is, to 0 or a predetermined value that is close to 0.

For example, in the case of the section 64 shown in FIG. 5, the set of microphone 51 and microphone 52, and the set of microphone 52 and microphone 53 both belong to the third sets, and the other sets all belong to the second sets. As a result of determining the factors as described above, if it is assumed that the sound sources are arranged at the positions of the microphone 51 and the microphone 52 (hereinafter, referred to as the "sound source 51" and the "sound source 52"), the sound image of the sound source 51 will be located at the position 61, and the sound image of the sound source 52 will be located at the position 65. Similarly, if it is assumed that the sound sources are arranged at the positions of the microphone 53 and the microphone 52 (hereinafter, referred to as the "sound source 53" and the "sound source 52"), the sound image of the sound source 53 will be located at the position 62, and the sound image of the sound source 52 will be located at the position 65. Furthermore, because the attenuation amounts for the microphones of the second sets are large, acoustic signals from these sets are hardly included in the acoustic signal R and the acoustic signal L that are output by the acoustic signal processing unit 11. With the above-described configuration, the sound field that corresponds to a section designated by a user can be reproduced when the stereo speakers are driven with the acoustic signal R and the acoustic signal L output by the acoustic signal processing unit 11.

Lastly, the section determination unit 12 determines the section based on an user operation. For example, if the user directly designates a section, the section determination unit 12 functions as an accepting unit for accepting an operation of the user designating the section. In this case, the section designated by the user is output to the acoustic signal processing unit 11. On the other hand, for example, if the present invention is applied to viewing an image on a VR head-mounted display or viewing a 360 degree panorama image on a tablet, the section determination unit 12 calculates the section based on the range of the image that the user is viewing, and outputs the calculated section to the acoustic signal processing unit 11.

The mixing device 10 of the present invention can be realized by programs for causing a computer that includes a processor and a storage unit to operate as the mixing device 10. These computer programs are stored in a computer-readable storage medium, or can be distributed via a network. The computer programs are stored in the storage unit, and are executed by the processor, so that the functions of the constituent components shown in FIG. 2 can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A mixing device for mixing acoustic signals collected by a plurality of microphones, comprising:

processing units that are each provided for a set of two microphones, out of the plurality of microphones, that are defined based on positions at which the microphones are arranged, each processing unit being configured to process acoustic signals output by the corresponding set of two microphones to output a first acoustic signal and a second acoustic signal;

a first adding unit configured to add up the first acoustic signals output by the processing units that correspond to the respective sets and output the resultant signal; and a second adding unit configured to add up the second acoustic signals output by the processing units that correspond to the respective sets and output the resultant signal, wherein each processing unit processes the acoustic signals output by the corresponding set of two microphones, based on a scaling factor that determines a scaling up/down rate of a sound field, a shift factor that determines a shift amount of the sound field, and attenuation factors that determine attenuation amounts of the acoustic signals output by the microphones.

2. The mixing device according to claim 1, further comprising:

an accepting unit configured to accept a user operation; and a determination unit configured to classify the sets based on the user operation, and determine, based on the classification result of each of the sets, the scaling factor, the shift factor, and the attenuation factors that are to be used by the corresponding processing unit.

3. The mixing device according to claim 2, wherein the plurality of microphones are arranged on a predetermined line, and the set of two microphones are microphones adjacent to each other on the predetermined line, and the user operation is an operation for designating a section on the predetermined line, and the determination unit is further configured to classify, if at least one microphone is included in the section, a set of two microphones that are included in the section into a first set, a set of two microphones that are not included in the section into a second set, and a set of two microphones only one of which is included in the section into a third set, and classify, if no microphones are included in the section, a set of two microphones located closest to both ends of the section into the third set, and another set into the second set.

4. The mixing device according to claim 3, wherein the determination unit is further configured to determine the scaling factors to be used by the processing units that correspond to the first set and the second set as a value with which the sound field does not scale up/down, and the shift factors to be used by the processing units that correspond to the first set and the second set as a value with which the sound field is not shifted.

5. The mixing device according to claim 3, wherein the determination unit is further configured to determine the scaling factor to be used by the processing unit that corresponds to the third set based on the length of a portion of the section that is present between the third set of two microphones, and the shift factor to be used by the processing unit that corresponds to the third set based on the distance between the midpoint between the positions at which the third set of two microphones are arranged, and the midpoint of the portion of the section that is present between the third set of two microphones.

6. The mixing device according to claim 3, wherein the determination unit is further configured to determine the attenuation factors of two acoustic signals to be output by the first set of two microphones, and the attenuation factors of two acoustic signals to be output by the third set of two microphones as a value with which the attenuation amount is smaller than that of the attenuation factors of two acoustic signals to be output by the second set of two microphones.

7. The mixing device according to claim 3, wherein the determination unit is further configured to determine the attenuation factors of two acoustic signals to be output by the first set of two microphones as a value with which the attenuation amount is 0.

8. The mixing device according to claim 6, wherein the determination unit is further configured to determine the attenuation factor of an acoustic signal to be output by a microphone that belongs to the third set and is included in the section as the same value as the attenuation factors of the two acoustic signals to be output by the first set of two microphones.

9. The mixing device according to claim 6, wherein the determination unit is further configured to determine the attenuation factor of an acoustic signal to be output by a microphone that belongs to the third set and is not included in the section as a value with which an attenuation amount is larger than that of the attenuation factors of two acoustic signals to be output by the first set of two microphones.

10. The mixing device according to claim 9, wherein the determination unit is further configured to determine the attenuation factor of an acoustic signal to be output by a microphone that belongs to the third set and is not included in the section, based on the distance to the section.

11. The mixing device according to claim 6, wherein the determination unit is further configured to determine the attenuation factors of two acoustic signals to be output by the second set of two microphones as a value with which the attenuation amount is the largest.

12. A non-transitory computer-readable storage medium that stores a computer program, wherein the computer program includes instructions of causing, when being executed by one or more processors of a device, the device to:

process acoustic signals output by each set of two microphones, out of a plurality of microphones, that are defined based on positions at which the microphones are arranged, and output the processed acoustic signals as a first acoustic signal and a second acoustic signal;

add up the first acoustic signals output by the processing units that correspond to the respective sets and output the resultant signal; and add up the second acoustic signals output by the processing units that correspond to the respective sets and output the resultant signal, wherein the outputting the first acoustic signal and the outputting the second acoustic signal include processing the acoustic signals output by the corresponding set of two microphones, based on a scaling factor that determines a scaling up/down rate of a sound field, a shift factor that determines a shift amount of the sound field, and attenuation factors that determine attenuation amounts of the acoustic signals output by the respective microphones.

* * * * *